United States Patent [19]

Whynacht et al.

[11] Patent Number: 4,622,538

[45] Date of Patent: Nov. 11, 1986

[54] REMOTE MONITORING SYSTEM STATE MACHINE AND METHOD

[75] Inventors: Charles Whynacht, Glastonbury, Conn.; Robert E. Hall, Singer Island, Fla.

[73] Assignee: Otis Elevator Company, Farmington, Conn.

[21] Appl. No.: 632,071

[22] Filed: Jul. 18, 1984

[51] Int. Cl.[4] ..... G08B 29/00; B66B 3/00

[52] U.S. Cl. ..... 340/506; 340/500; 340/508; 340/511; 340/518; 340/19 R; 340/525; 340/539; 187/29 R; 364/436; 364/551

[58] Field of Search ..... 340/506, 500, 511, 518, 340/508, 524, 525, 510, 529, 19 R, 19 A, 20, 21, 539, 825.05, 825.06; 187/29 R; 364/436, 551, 578

[56] References Cited

U.S. PATENT DOCUMENTS

| | | | |
|---|---|---|---|
| 3,665,399 | 5/1972 | Zehr et al. | 340/518 |
| 3,676,878 | 7/1972 | Linder | 340/518 |
| 3,925,763 | 12/1975 | Wadhwani et al. | 340/534 |
| 4,222,041 | 9/1980 | Von Tomkewitsch et al. | 340/506 |
| 4,414,539 | 11/1983 | Armer | 340/500 |
| 4,523,183 | 6/1985 | Frick | 340/506 |

*Primary Examiner*—Donnie L. Crosland

*Attorney, Agent, or Firm*—Francis J. Maguire, Jr.

[57] ABSTRACT

A plurality of different types of operating systems in buildings organized in geographical groups, each group having a local service office, are monitored at both the local offices and central office for the presence of performance conditions and conditions indicative of an alarm condition.

15 Claims, 2 Drawing Figures

REMOTE MONITORING SYSTEM STATE MACHINE AND METHOD

DESCRIPTION

1. Technical Field

This invention relates to monitoring selected parameters of a plurality of operating systems at a plurality of remote sites, to determining the presence of an alarm condition according to a state machine model, to transmitting alarm condition signals to a local office for initiating service actions, and to retransmitting alarm conditions signals to a central office for evaluation.

2. Background Art

Any number of systems operating at a plurality of remote sites may be monitored using sensors at the remote sites and transmitting information on the present status of the sensed parameters durinq the systems's operation at the sites, such as elevator systems in a pluralitv of remote buildinqs. The parameters selected for monitoring are chosen according to their importance in evaluating the operational condition of a system. In the case of an elevator system, typical sensors would include, among others, an alarm button sensor, a door fully opened sensor, a leveling sensor, a demand sensor, and a brake fully engaged sensor. These sensors produce signals which may be multiplexed into a transmitter for transmittal to a local office which monitors the status of the plurality of elevator systems. Upon receiving a signal indicating an abnormal conditon, the local office personnel may logically infer the operational condition of the system by noting the presence or absence of other abnormal conditon signals or other associated sensor parameters. For example, if an alarm button pressed and a door closed signal are both received, a condition in which a person is possibly trapped within an inoperative elevator car may be inferred. Additional pieces of information can be transmitted to make the evaluation task easier. Generally, the more information received, the more accurate the conclusions that may be drawn concerning the nature of conditions. For example, if in the above example, additional pieces of information are provided indicating that the car is within a door zone, that it has leveled properly with respect to a hall landing, and that the car brake is fully engaged, the type of inoperative conditon that has occurred can be considerably narrowed. A service man is then dispatched to the remote locaton having at least some foreknowledge of the nature of the inoperative condition which permits him to make adequate preparations for quickly correcting the condition.

As the number of monitored parameters increases, the task of evaluating whether and what kind of an alarm condition exists, if any, becomes more difficult. If a local office is monitoring a large number of systems, the amount of performance information received can be very high making the intrepretative task even more difficult.

An additional difficulty in using large numbers of monitored parameters is that the interpretative task itself can become extremely complex, making it likely that the interpretative errors or oversights may occur. If such an error or oversight occurs, the owner of the building in which the inoperative elevator car is located will eventually telephone requesting a serviceman and providing whatever knowledge he may have concerning the nature of the inoperative condition. However, this is a highly undesirable form of receiving the information needed to efficiently deploy a service organization. This is especially true when a monitoring system has been installed in a building for the purpose of immediately detecting such inoperative conditions at a local service office.

Inventor Charles Whynacht invented a REMOTE ELEVATOR MONITORING SYSTEM, U.S. Ser. No. 562,624, assigned to the assignee of this invention, which monitors a large number of remote sites at locals and a central and which solves the above described problem for some systems including elevator systems. One of the objects of the Whynacht invention was to provide an operating system monitor capable of monitoring parameters and evaluating their states in order to form conclusions concerning the system's performance and to determine whether any predefined alarm conditions were present. According to the Whynacht invention the sensed parameters were stored by a signal processor and compared to previously received values in order to determine if any parameters had changed state. If so, the present value of the changed parameter(s) was plugged into a Boolean expression defining an alarm condition in order to determine if the Boolean expression was satisfied and hence the alarm conditon was present. If so, an alarm conditon signal was transmitted and displayed as an alarm message.

In addition, the Whynacht invention embraced a group of monitored systems in, for example, a particular geographical area and monitored the various individual systems at a central location in the local geographical area so that appropriate area service actions could be effectively managed. In addition, the Whynacht invention disclosed that many local offices may be grouped together into an overall group which all transmit their data to a headquarters office which monitors many local offices in different geographical areas.

During the development of the Whynacht invention, it became apparent that the approach of a timed scanned "snapshot" of elevator conditions did not offer a sufficient degree of confidence in the accurate detection of alarm conditions. In addition, the variability of elevator wiring encountered in the field often made the large number of functional input points from the elevator functionally inconsistent. This combination of circumstances resulted in an unacceptable correlation factor of alarm detection and installation complexity therein.

DISCLOSURE OF INVENTION

The object of the present invention is to provide improved apparatus for monitoring an operating system by monitoring selected parameters indicative of the present operating condition of the system and evaluating the parameter states in order to form accurate conclusions concerning the system's performance to a high degree of certainty and concerning whether any predefined alarm conditions are present.

According to the present invention, the sensed parameters to be evaluated are received and stored by a signal processor which compares the present received values of parameters selected according to the present operating condition of the system with values indicative of specific system conditions to determine if any parameter has entered a state indicative of a transition from the present operating condition to another operating condition or to an inoperative condition. The signal processor or an external counter can be employed to keep track of the number of occurrences of such transitions and to provide performance signals indicative of the total count of transitions from particular states to other states thus providing performance signals indicative of system performance. Transitions from inoperative conditions to alarm conditions are also monitored and alarm signals are generated for each such transition. Thus, a "state machine" is created which may take the form of a closed loop of normal operating states, each state of which may be exited to an inoperative condition. Each inoperative condition may also serve as a transition point either to an alarm condition state or back to one of the operating states in the closed loop. Each alarm condition state may also serve as a transition point to another alarm state or back to an inoperative state or an operating state in the closed loop.

In further accord with the present invention, a plurality of such monitored systems may be grouped such that their individual performance and alarm condition signals are transmitted to a local office where they are evaluated by local service personnel so that appropriate service actions may be taken on a timely basis.

In still further accord with the present invention, a plurality of such local offices may retransmit performance data and alarm messages from their associated operating systems to a central office which monitors many local offices.

The remote system monitor of the present invention provides an intelligent means of automatically evaluating the operational status of an operating system. It also may be used for automatically evaluating the status of a plurality of systems organized in local geographical areas each reporting to an associated local office. The demanding task of evaluating many hundreds, thousands, or hundreds of thousands of performance data is greater reduced by providing a "state machine" defining proper performance and alarm conditions. The automatic provision of alarm messages to the local office ensures that proper evaluation of the performance data leads to efficient deployment of the local office service force. When retransmitted to a cental office essential information necessary for long term performance projections and for the evaulation of the effectiveness of local service offices is provided for use by central office personnel.

BEST MODE FOR CARRYING OUT THE INVENTION

Figure 1:
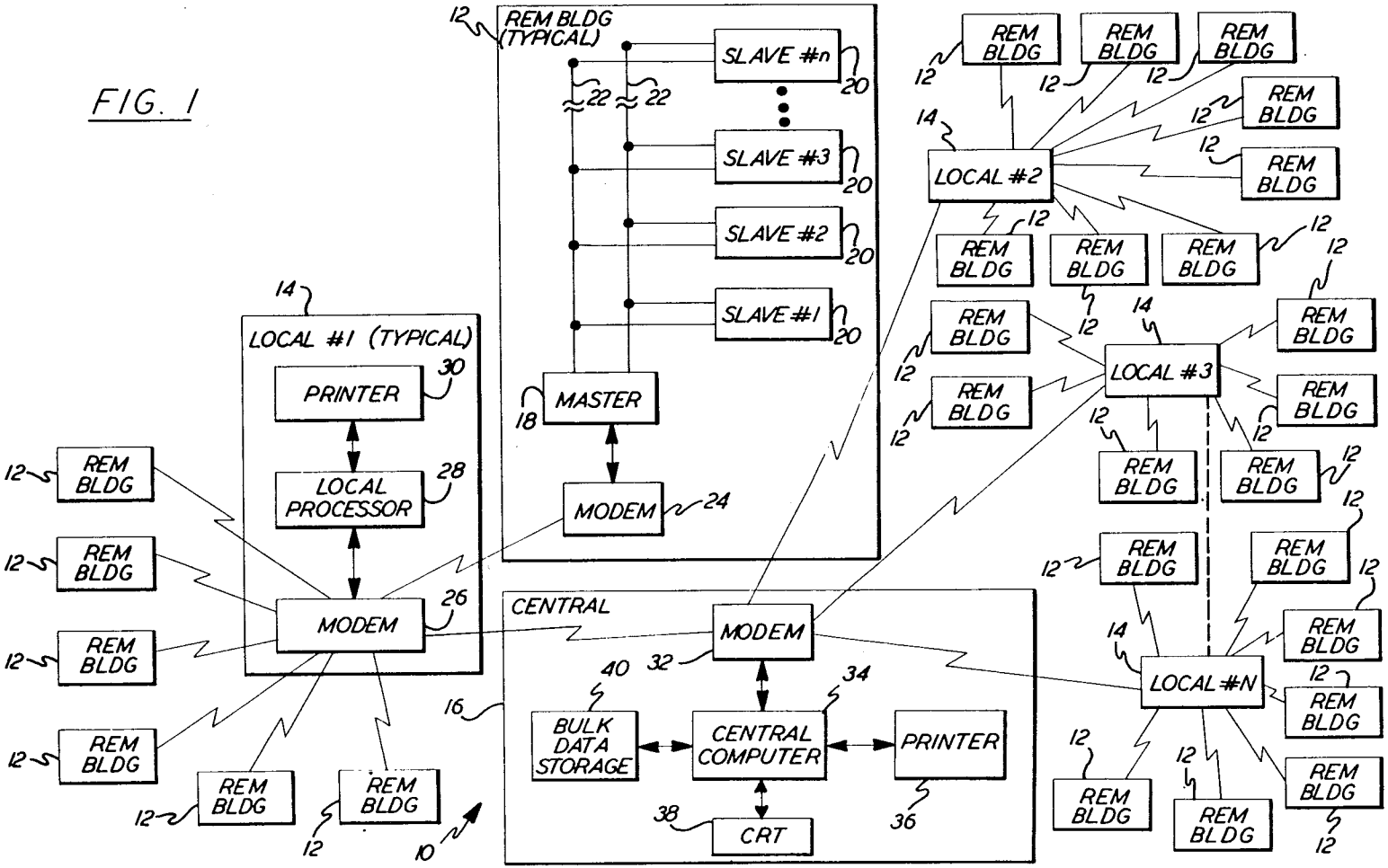
FIG. 1 is an illustration of an elevator monitoring system for monitoring individual elevators in remotely located buildings, for transmitting alarm and performance information to associated local monitoring centers, and for retransmitting the alarm and performance information from the locak centers to a central monitoring center.

FIG. 1 illustrates the present remote elevator monitoring system 10 for monitoring individual elevators in remotely located buildings 12, for transmitting alarm and performance information to associated local monitoring centers 14 and for retransmitting the alarm and performance information from the local centers to a central monitoring center 16. The method of communication between the remote buildings and the various local offices and the centralized office is a unidirectional communication system whereby inoperative elevators are identified and individual elevator performance information is transferred to a local monitoring center through the use of local telephone lines which may include microwave transmission paths. The local then forwards these messages to the central monitoring center also using telephone lines, but in this case, long distance area wide service is almost always used. It should be understood that although the remote elevator monitoring system (REMS) disclosed herein utilizes the public switch phone network available within the local community in which a particular local monitoring center and its associated remote buildings are located, other equivalent forms of communication may be utilized. Each remote building of the REMS system includes a master 18 and one or more slaves 20. The individual slaves are attached to sensors associated with an associated elevator and elevator shaft. The slaves transmit signals indicative of the status of selected parameters via a communications line 22 which consists of an unshielded pair of wires. The use of a two wire communications line between the master 18 and its associated slaves 20 provides both an inexpensive means of data transmission and the ability to inexpensively locate the master at a location remote from the slaves. For instance, if all of the slaves are located in an elevator machinery room having a hostile environment on top of the elevator shafts, the master may inexpensively be located in a more benign environment somewhere else in the building. Each master includes a microprocessor which evaluates the performance data and determines whether an alarm condition exists according to a state machine model which is coded within the software of the microprocessor. Each master communicates with a modem 24 which transmits alarm and performance data to a modem 26 in the associated local monitoring center 14. Although the architecture of the REMS within a remote building has been described as having a master communicating with one or more slaves using an efficient two wire communications line, it should be understood by those skilled in the art that other means of data collection and transmission including less efficient means may also be used. It should also be understood that because the number of slaves capable of being attached to a given communications line is finite, it may be necessary within a given remote building to utilize more than one master-slave group.

Each of the remote buildings 12 communicates with its associated local monitoring center 14 to provide alarm and performance data. The local processor 28 stores the received data internally and alerts local personnel as to the existence of an alarm condition and performance data useful for determining the cause of the alarm. The local processor 28 alerts local personnel of these conditions via a printer 30. It should be understood that other means of communicating with local personnel, such as a CRT may as easily be used. The local processor 28 also causes alarm and performance data from the local's remote buildings to be transmitted to a modem 32 within the central monitoring center 16. A central computer 34 receives data from the modem 32 and provides alarm and performance data to central personnel via a printer 36 and a CRT 38. It should be understood that although both a printer and a CRT are shown for use with the invention, the use of only one of them would be sufficient to fully communicate with the central personnel. A bulk data storage unit 40 is used to store alarm and performance data for a long term evaulation by central personnel. Although bulk data storage is a desirable feature of the present invention, it should be understood that bulk data storage for the the purpose of long term performance evaulation is not absolutely essential for the practice of the present invention. The REMS described above in connection with the illustration of FIG. 1 is designed to permit a local office to monitor elevators located within its geographical area so that upon the detection of an abnormal condition a serviceman may be immediately dispatched for quick resolution of the problem. In this way, the quality of services performed for the elevator customer is greatly improved. In many cases, a deteriorating condition may be detected before it causes a elevator disablement. In cases where a disablement has occurred, the nature of the problem can often be identified before dispatching the serviceman so that the nature of the corrective action required may be determined in advance. Central office personnel are also kept informed as to performance, operating problems, and disablements in all elevators in the field. This orovides an extremely valuable management tool the headquarters operation. Personnel at the central monitoring center 16 are enabled to closely monitor the performance of essentially all of the elevators in the field. Performance trends can thereby be detected and accurate forecast devised for use in businss planning. The instantanous nature of the knowledge provided as to the effectiveness of the service force in remedying field problems is also an invaluable aid to management in identifying and correctinq local service offices having unsatsfactory service records.

Of course, it should be understood that while the illustration of FIG. 1 illustrats an embodiment of the invention as applied to a remote elevator monitoring sytem, the invention is not restricted only to applications in the elevator monitoring art. The invention is equally appliable to other system monitoring functions in which intelligent evaulation of system performance data is required. It is also equally applicable for applications in which only local monitoring of distributed systems is required. Of course, central monitoring of distributed local monitoring centers for any type of operating system is also embraced by the invention.

The specific teachings of the Whynacht invention referred to above, i.e., U.S. Ser. No. 562,624, with respect to a particular hardware implementation of the data gathering function and the communications protocol employed therein is hereby expressly incorporated by reference. Of course, it should be understood that the particular teachings of the incorporated Whynacht disclosure is merely one means of carrying out the data gathering and communications protocol aspect of the invention described herein.

Figure 2:
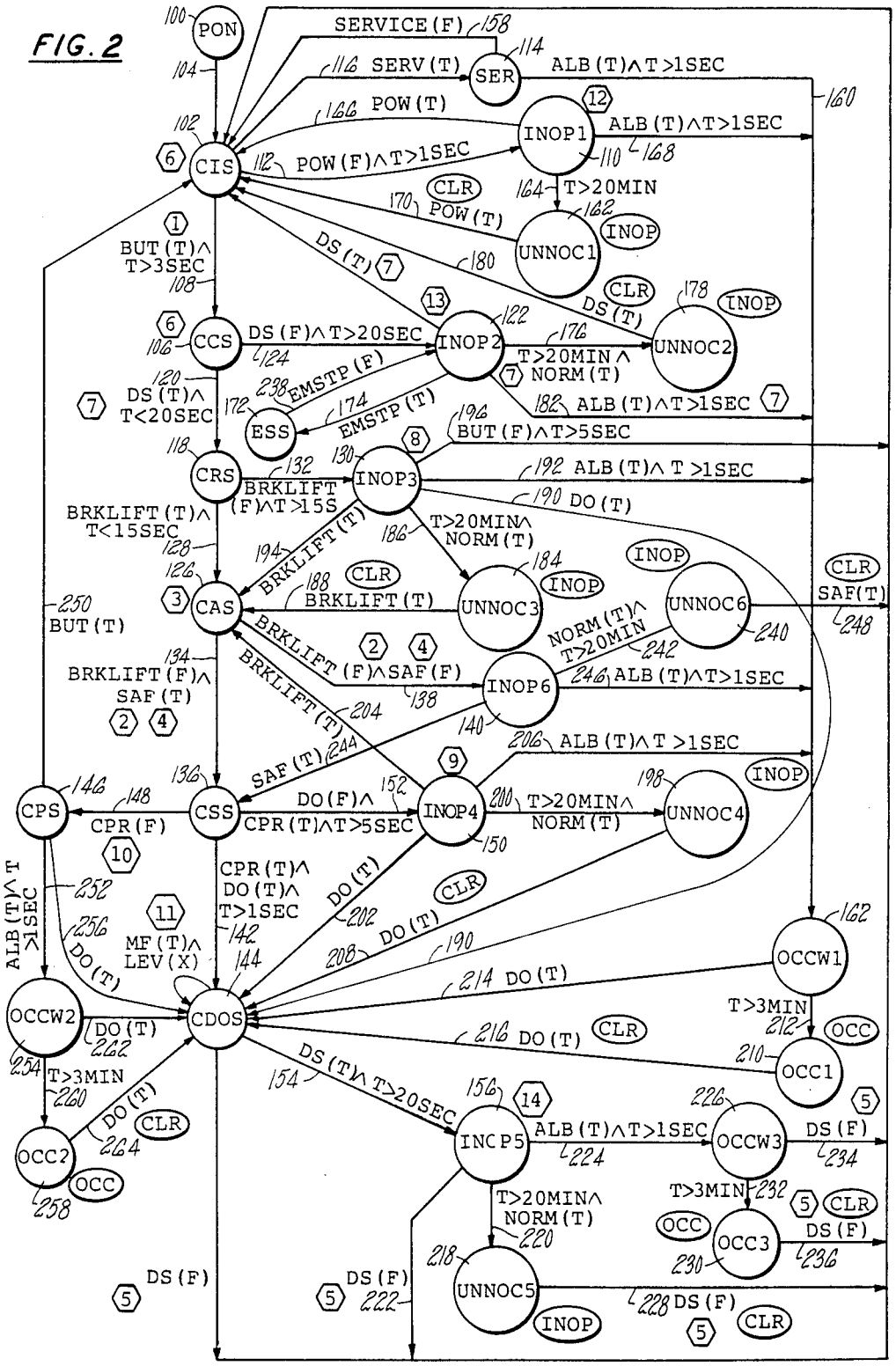
FIG. 2 is a state machine model, according to the present invention, of an elevator system which normally operates from state-to-state in a closed loop sequential chain of normal operating states.

Referring now to FIG. 2, a state machine model of an elevator system in which transitions from state-to-state following a typical sequence of elevator operations, is shown. Because all elevators perform the same general functions, they contain similar rudimentary control and status points within their controllers. In addition, most elevators perform an equivalent sequence of operations when performing their normal functions. The state machine described herein, in connection with FIG. 2, when interfaced to such basic points, in effect monitors the entire sequence of operations that the elevator performs. If the elevator fails to follow the normal sequence, or fails to meet the criteria for transitioning between successive states representative of normal operation, an inoperative condition or a failure condition is detected by a transition out of the normal sequence of states into an inoperative or alarm state.

Each state that the elevator can assume is represented graphically in FIG. 2 by a circle. Mnemonics used within a circle identify the state. All permissible transitions between states of the elevator are represented graphically by arrows in between circles. Each transition is qualified by an expression whose value is either true or false. The elevator remains in its current state if all the expressions which qualify the transitions leading to the other states are not satisfied. The new state is entered immediately after the expression(s) become(s) satisfied unless a time value is specified. An expression consists of one or more state linkages or minimum time limits used in conjunction with the operators: AND, OR, or NOT. Time is represented by the symbol T. This symbol achieves a true value only after the elevator has been in the state for the time value specified. It will remain true until the state is exited. The AND operator is represented by the symbol $\wedge$ . The OR operator is represented by the symbol $\vee$ . The AND operator takes precedence over the OR operator within an expression unless specified by parenthesis. The NOT operator is represented by a horizontal bar placed over the portion of the expression to be negated. The resulting negated expression has a true value if, and only if, the value of the expression under the bar is false. If a transition is further qualified by a maximum time limit, then the state pointed to shall be entered within the specified amount of time after the exression becomes true. If a portion of an expression is optional or a "dont't care" situation is indicated, (in that its true value is not required for the complete expression to be ture) then it is enclosed within square brackets.

Associated with certain states are messages which indicate that the REMS unit shall transmit a message to the local and/or the central location. These messages are represented graphically in FIG. 2 by an oval adjacent to states indicative of alarm conditions. Mnemonics used within an oval identify the message content to be explained in more detail below. These messages may be associated with the occurrence of a transition between states as well.

In the following description, any malfunction by the elevator or elevator controller which results in a failure to transition from a particular state in the normal sequence is detected. The specific transition out of the normal sequnce is detected and identified by a transition to a particular inoperative condition. It should be kept in mind that the state machine illustrated in FIG. 2 serves a monitoring function whereas an actual failue of the elevator is the causal factor while the detection merely serves a monitoring function of the elevator system.

Definitions for the mnemonics for the states of FIG. 2 are as follows:

TABLE I

| State Description | Mnemonic |
|---|---|
| Power On State | PON |
| Car Idle State | CIS |
| Car Call State | CCS |
| Car Ready State | CRS |
| Car Active State | CAS |
| Car Stopped State | CSS |
| Car Door Open State | CDOS |
| Emergency Stopped State | ESS |
| Service State | SER |

TABLE I-continued

| State Description | Mnemonic |
|---|---|
| Car Parked State | CPS |
| Inoperative State 1 | INOP1 |
| Inoperative State 2 | INOP2 |
| Inoperative State 3 | INOP3 |
| Inoperative State 4 | INOP4 |
| Inoperative State 5 | INOP5 |
| Inoperative State 6 | INOP6 |
| Unoccopied State 1 | UNNOC1 |
| Unoccupied State 2 | UNNOC2 |
| Unoccupied State 3 | UNNOC3 |
| Unoccupied State 4 | UNNOC4 |
| Unoccupied State 5 | UNNOC5 |
| Unoccupied State 6 | UNNOC6 |
| Occupied Wait State 1 | OCCW1 |
| Occupied Wait State 2 | OCCW2 |
| Occupied Wait State 3 | OCCW3 |
| Occupied State 1 | OCC1 |
| Occupied State 2 | OCC2 |
| Occupied State 3 | OCC3 |

In addition to the state lists, the following message list definitions are provided:

A LIST OF THREE MESSAGES

Inoperative Elevator, INOP Message
Inoperative Elevator, OCC Message
Alarm Condition Clear Message, CLR These messages are identical to and functionally equivalent to the messages for occupied and unoccupied messages as described in the original Whynacht invention previously incorporated herein by reference.

In addition to detecting abnormal elevator conditions, performance data associated with the operation of the elevator is also collected. This data consists of the monitoring of a number of elevator functions. Contained within the diagram are octagon symbols with numbers contained within them. These numbers represent the moments in time when the specific counters and times are to begin operation and to cease operation and are described in more detail below.

The data input points listed below in Table II are utilized by the elevator state machine of FIG. 2. The eight data inputs that are listed are those normally associated with a single, automatic, push-button (SAPB) configuration of elevator. It should be recognized that this is the minimum configuration of the state machine and that this configuration represents the simplist elevator in operation today, i.e., a single shaft with a single hoist elevator.

TABLE II

| Input Variable | Mnemonic |
|---|---|
| Emergency Stopped; Safety Chain SAF | EMSTP; |
| Hall Call or Car Call Button | BUT |
| Hoistway Door Lock | DS |
| Elevator Brakelift | BRKLIFT |
| Door Open Actuator | DO |
| Occupied Alarm Bell | ALB |
| Maintenance Service | SERV |
| Elevator Power | POW |

In addition to this SAPB configuration, the state machine is functionally operational for multi-shaft way configurations, i.e., those buildings containing multiple elevators controlled by group dispatchers. To accommodate the additional complexity of these installations, it is usually necessary that four more inputs be monitored by the state machine; it should be understood that these inputs only add to the complexity of the simple machine for the SAPB. A simple SAPB machine and a complex multi-group machine do not differ in theory of operation, but only in the ability to detect additonal states. In the diagram of the state machine, "true" refers to the affirmed condition of the input in a logical sense only. The absence or presence of voltage from a field contact is not in this case defined, but is a function of the individual wiring at the field site. The best mode hardware implementation allows for either the presence or absence of voltage to assume the true function, as described fully in the previous Whynacht disclosure referred and previously incorporated herein above.

TABLE III

| Input Variable | Mnemonic |
|---|---|
| Car Park Recognition | CPR |
| Attendant Operation | NORM |
| Master Floor | MF |
| Levelling | LEV |

A detailed description of the operation of the state machine follows. Each state in the diagram of FIG. 2 will be described along with the requirements and conditions for transition out of the state to another succeeding state. It should be understood that the actual hardware implementation of the state diagram of FIG. 2 would require a programmer to encode all of the requirements of the figure in a particular language according to the particular hardware being used; however, the encoding details are not described because the particular hardware and programming techniques utilized are a matter of choice not embracing the inventive concept.

Upon application of power to the machine, a power-on state 100 will be entered after all self-test checking by the processor unit is completed. After entering the power-on state 100 the state machine will transition to a car idle state 102 as signified by a transitional line 104. It is anticipated that when an elevator is powered up, the elevator that is being monitored is running and in operation; therefore, no requirement is imposed upon alarming from the power-on state 100. There is an implied entrance into the power-on state 100 anytime power is applied or power is interrupted momentarily to the unit. Anytime a processor reset occurs, the state machine will begin from the power-on state 100.

The car idle state 102 functionally represents a car which has no demand and is waiting at a floor. Door positions are irrelevant. In order to exit the car idle state under normal operation, a button input usually from a passenger either at a hall landing or within a car is detected true for three seconds. The button will go true whenever a hall call or car call is registered on the car in a single automatic push-button configuration. In the case of a multi-car configuration, a button going true represents a "demand" or "go" signal from the group dispatcher function to the car. Upon detecting a true condition of the button input for greater than three seconds the state machine will sequence from the car idle state 102 to a car called state 106 as signified by a transitional line 108. An abnormal transition from the car idle state 102 can occur if the elevator power goes false for greater than one second. In this case, the state machine will sequence from the car idle state 102 to an inoperative state 1 (INOP 1) 110 as signified by a transitional line 112. A third transition condition out of the car idle state 102 occurs when service goes true indicating that maintenance is being performed on the elevator car itself. This condition will cause the state machine to sequence from the car idle state 102 to an attendant state 114 as indicated by a transitional line 116.

The car called state 106 functionally represents a car which has been dispatched true by either a call from a hall or car button for a SAPB configuration or via a demand/go signal from a group dispatcher. The car is still at a floor but now has been activated by a signal to cause it to move. Two transitions are possible from the car called state 106. A normal transition occurs when the hoistway door locks makeup, i.e., the hoistway door lock variable goes true within a time period of twenty seconds from the entrance into the car call state. Upon this occurence the state machine will sequence from the car called state 106 to a car ready state 118. In the event that the hoistway lock variable does not go true but remains false for a period of time greater than twenty seconds from the entrance into the car called state 106 then an abnormal transition of the state machine will occur from the car called state 106 to an inoperative 2 (INOP 2) state 122, as indicated by a transitional line 124.

The car ready state 118 functionally represents the condition that the car has been commanded to go, and the hoistway door locks have closed. There are two transitions possible from the car ready state. The normal transition is the occurrence of a brakelift on the elevator car. This brakelift must occur within fifteen seconds after entering the car ready state 118. Upon the occurrence the brakelift within fifteen seconds, the state machine will sequence from the car ready state 118 to a car active state 126 as indicated by a transitional line 128. In the event that the brakelift does not occur within fifteen seconds from entry into the car ready state, the state machine will sequence from the car ready state 118 to an inoperative 3 (INOP 3) state 130 as indicated by a transitional line 132. This is an abnormal transition from the car ready state 118.

The car active state 126 functionally represents the condition that the car is in motion. It can not be assumed at anytime that the car is either in or outside of a door landing. Although in all probability, once entrance into the car active state 126 is effected, the car will not be positioned at a floor, but will be in some intermediate position between landings. The car active state is the normal run mode for the elevator car and is the predominant mode that the elevator takes during a run. Upon approaching the terminal landing of the elevator run, whether it be a single floor or a multi-floor run, at some point the car will begin to decelerate and stop at the desired landing for which the button signal generated the initial go for the elevator car. At the appropriate time the controller for the elevator car will drop the brake for the car to stop it at the landing that has been determined to be correct for the initial go signal. The normal transition out of the car active state is the occurrence of this brake drop. It is signified by the input brake going false as indicated on a transitional line 134 to a car stopped state 136. The safety chain input variable is included in the transitional expression in order to provide a check for a normal elevator stopped condition. Upon the occurrence of this, the state machine will sequence from the car active state 126 to the car stopped state 136. Note that the state machine assumes no time limit between going from the car active state 126 to the car stopped state, since it is not known how long the actual run will take. Nor is it of any importance to the state machine in monitoring the sequence of operations. An abnormal transition from the car active state 126 is the detection of the safety chain variable being false along with the brakelift variable being false as indicated by a transitional line 138 to an inoperative 6 (INOP 6) state 140. The transition on the line 138 indicates a stoppage of the elevator car by the opening of the safety chain (the safety chain is a chain of series connected normally closed safety related contacts the opening of any one or more of which constitutes a braking of "the safety chain" and the assumption by the safety chain of a false value.

The car stopped state 136 functionally represents the condition that the brake has dropped on the elevator and the car has now stopped. At this point it is not known whether the car has stopped at a floor or at some indeterminate point between landings. It is the purpose of this state to detect which of the these conditions is true. A normal transition from the car stopped state is the assumption by the door open variable of the true value within one second of entering the car stopped state 136. An additional input, variable car parked recognition (true), is included in the transitional equation for the multi-car configuration since the parking of an elevator car under a group dispatcher function is possible for this configuration as indicated by a transitional line 142 to a car door open state 144. For the single automatic push button (SAPB) the car parked recognition input variable does not exist. Upon the assumption of the door open variable of a true value within one second of entering the car stopped state 136, the state machine will sequence from the car stopped state 136 to the car door open state 144. Another normal transition, in the case of the multi-car configuration, from the car stopped state 136 is the assumption by the car parked recognition input variable of a false value after entering the car stopped state 136. This result in an immediate transiton to a car parked state 146 as indicated by a transitional line 148. As explained earlier, multi-car configuration systems provide the input car parked recognition variable and have an associated car parked state 146 implemented in the state machine. An abnormal transition from the car stopped state 136 is the detection of the door open variable remaining false for a period of greater than five seconds after entering the car stopped state 136. This will result in a transition to an inoperative 4 (INOP 4) state 150 as indicated by a transitional line 152. The car parked recognition variable is included in this equation if the state machine supports a multi-car configuration.

The car door open state functionally represents the opening of the inner doors of the elevator after the car has stopped at a floor. It represents the conclusion of a normal elevator run. Upon entrance to the car door open state, the state machine performs a check of leveling (if leveling performance monitoring is installed for the particular elevator configuration). This leveling check is not a unique state and is therefore not illustrated in FIG. 2 but is rather a performance measure which is associated only with the occurrence of the car door open state 144 itself. The normal transition from the car door open state occurs upon detection of the opening of the hoistway doors (the door switch variable going false) which results in a transition to the car idle state 102. This represents a completed sequence of elevator operation and will result in the beginning of the entire sequence again. The abnormal transiton condition from the car door open state 144 is for the door switch to remain true for a period of greater than twenty seconds after the state machine enters the car door open state 144 as indicated by a transitional line 154 to an inoperative 5 (INOP 5) state 156. This represents the occurrence of a locked hoistway door or a failure of the elevator doors to open for some other reason.

The service state 114 functionally represents the performance of some maintenance action upon an elevator by a qualified repair man. The service variable acheives a true value when the service switch associated with the elevator is turned to the true position. The detection of the occurrence of the service variable going true will cause a transition from the car idle state 102 to the service state 114 (the service state is also referrred to as the attendant state). As a result of this transition, all performance monitoring in abnormal elevator shutdowns with the exception of an occuppied trapped passenger are overridden, i.e., they are ignored. The normal transition from the attendant state is the detection of the service variable in the false condition as indicated by a transition line 158 back to the car idle state 102. This normal transition represents the time when the maintenance operator releases the switch indicating that he has performed his maintanence action on the elevator. At that time, the state machine sequences from the attendant state 114 to the car idle state 102 and begins again to monitor all operations of the elevator for abnormal, occupied, and unoccupied shutdowns along with monitoring performance criteria. An abnormal transition from the attendance state can occur if the alarm bell variable is held true for a period of greater than one second as indicated by a transitional line 160 to an occupied wait 1 (OCCW 1) state 162. This represent the case where somehow the maintenance operator or a passenger has managed to trap himself within an elevator while undergoing maintanence service.

Upon detection of the power variable going false for greater than one second the state machine transitions from the car idle state 102 to the inoperative 1 state 110. Upon entrance into the inoperative 1 state 110, a twenty minute timer begins to measure the elapsed time starting at the time the state machine entered the inoperative 1 state 110. If the elevator does not perform a normal transition from the INOP 1 state 110 back to the car idle state 102 within the twenty minutes allowed, a transition will occur from the inoperative 1 state 110 to an unoccupied 1 (UNNOC 1) state 162 as indicated by a transitional line 164. This transition signifies the detection of an abnormal elevator shutdown. The normal transition condition from the inoperative 1 state 110 is the detection of the power variable going true within the twenty minute time period as indicated by a transitional line 166. In this case, the state machine will sequence from the inoperative 1 state 110 back to the car idle state 102 and will resume monitoring of the elevator. A second abnormal transition from the inoperative 1 state 110 occurs upon the detection of the alarm bell variable going true for greater than one second as indicated by a transitional line 168 to the occupied wait 1 state 162. If a passenger were to somehow become trapped in the elevator from the car idle state, the detection of the alarm bell variable in the true condition for greater than one second would generate this transition.

Upon entering the unoccupied 1 state 162, the state machine will immediately send an inoperative abnormal elevator shutdown message to the local 14 of FIG. 1. The unoccupied 1 state 162 functionally represents an abnormal elevator shutdown which has occurred due to a power failure of the elevator. As such, a detection of this state represents an abnormal elevator shutdown. The only transition from the unoccupied 1 state 162 is back to the car idle state 102 as indicated by a transitional line 170. The transition from the unoccupied 1 state 162 to the car idle state 102 occurs when the power variable goes true and will result in the sending of an alarm condition corrected message (CLR) to the local 14.

The inoperative 2 state 122 functionally represents a failure of a hoistway door to close. Upon entrance into the inoperative 2 state 122, a check is made of the emergency stop input variable. If it is true, then the emergency stop button has been pressed and a transition to an emergency stopped state 172 occurs as indicated by a transitional line 174. If the emergency stop variable is false, a timer begans measuring the time from when the state machine enters the INOP 2 state 122 until twenty minutes have elapsed. For multi-car operation, a check is also performed on the normal input variable to ensure that it is true before transitioning as indicated by a transitional line 176 to an UNNOC 2 state 178. The normal input variable represents the capability of an operator in multi-car configuration to place one of the elevator cars upon attendant operation. For that specific case, the timer is disabled. Upon the accumulation of twenty minutes by the timer (and the normal variable having a true value in a multi-car configuration) an immediate transition is made into the unoccupied 2 state 178. A transition from the inoperative 2 state 178 occurs upon the door switch variable going true as indicated by a transitional line 180 to the car idle state 102. This transition will cause the generation of an alarm clear message indicating that the inoperative message previously sent upon entering the unoccupied 2 state 178 is no longer valid. A third transition from the inoperative 2 state 122 is the detection of the alarm bell variable going true for greater than one second as indicated by a transitional line 182 to the occupied weight 1 state 162. This functionally represents the occurence of a passenger being within the elevator when the hoistway doors have failed to close up.

As previously discussed, upon entrance to the unoccupied 2 state 178 due to the accumulation of more than twenty minutes while waiting in the inoperative 2 state 122, the state machine will immediately transmit an inoperative abnormal elevator shutdown message to the local. The state machines remains in the unoccupied 2 state 178 until the detection of the door switch variable going true at which time an immediate transition is made to the car idle state 102. Upon this transition an "alarm condition corrected" (CLR) message is transmitted to the local.

The inoperative 3 state 130 functionally represents the failure of the brake to lift for the elevator car within fifteen seconds of the state machine entering the car ready state and the brakelift variable at the same time being false. Upon entrance to the state 130 a twenty minute timer begins to time how long the state machine remains in the inoperative 3 state 130. If this timer measures twenty minutes, an immediate transition is made to the unoccupied 3 (UNNOC 3) state 184 as indicated by a transitional line 186. The normal input variable, for multi-car applications is included in the transitional expression shown accompanying the transitional line 186 for the same reasons it was included in connection with the transitional line 176 which defined a transition from the inoperative 2 state 122 to the unoccupied 2 state 178. While the state machine is in the unoccupied 3 state 184, should a brakelift occur prior to twenty minutes of accumulated time, the state machine will make an immediate transition to the car active state 126 as indicated by a transitional line 188. Another possible transition from the inoperative 3 state 130 to the car door open state 144 occurs when the door open variable is detected going true within twenty minutes of entering the inoperative 3 state 130. This produces an immediate entrance to the car door open state 144 as indicated by a transitional line 190. A transition from the inoperative 3 state occurs upon the detection of the alarm bell variable going true for a period of greater than one second as indicated by a transitional line 192 to the occupied wait 1 state 162. This would represent a passenger being trapped within the car. The state machine, in addition to the above mentioned transitions from the inoperative 3 state 130, contains a counter which is incremented upon every entrance into the inoperative 3 state 130. This counter is cleared if the brakelift variable goes true causing a transition to the car active state 126 as indicated by a transitional line 194 or if the button variable is false for greater than five seconds as indicated by a transitional line 196 to the car idle state 102. Upon every entrance into the inoperative 3 state 130, after implementing the counter, the value of the counter is tested for a value of five. It is possible for a controller malfunction to cause the brake to fail to lift and to sequence through the states: car door open, car idle, car called, car ready, and INOP 3 without having the car ever move. This would represent the condition whereby a passenger gains entrance to a car, creates a demand, has the doors close, but then the car does not move due to a brake failure. A passenger may at that time push the door open button contained within the car and exit the car. Such an elevator is inoperative. In the event that five such sequences of the above mentioned states occur without a brakelift, a message is immediately sent to the local of an abnormal elevator shutdown. In addition, the total number of entrances into the inoperative 3 state by the state machine is accumulated during each performance period (typically one day) as a monitor of the elevator's performance, since it is possible for a deteriorating brake as evidence by a slow brake condition to be detected in this way.

If the state machine occupies the inoperative 3 state 130 for greater than twenty minutes an immediate transition is made to the unoccupied 3 state 184. This represents the occurrence of a brake failure and results in an abnormal elevator shutdown message being transmitted to the local. The only exit from the unoccupied 3 state 184 occurs upon the detection of the brakelift variable going true which will produce an immediate transition as indicated by the line 188 to the car active state 126. Such a transition will immediately generate an alarm condition correction message (CLR) at the local.

The inoperative 4 state 150 represents the condition of the door open variable going false corresponding to a door open actuator failure. Upon entrance into the inoperative 4 state 150 a twenty minute timer begins to measure the length of time the state machine remains in the inoperative 4 state. If after twenty minutes a door opens or brakelift has not occured, the state machine will enter an unoccupied 4 (UNNOC 4) state 198 as indicated by a transitional line 200. The normal variable is included in the expression adjacent to the transitional line 200 for multi-car configurations. In all other cases it would be omitted, as in the transitional lines 186, 176. It is possible to transition from the inoperative 4 state 150 to the car door open state 144 upon detecting the door open variable going true as indicated by a transitional line 202. It is also possible to transition from the inoperative 4 state 150 to the car active state 126 upon detection of the brakelift variable going true as indicated by a transitional line 204. As described in connection with the inooerative 3 state 130, successive occurences of the inoperative 4 state 150 are counted. The occurence of the door open variable going true clears this counter. If five successive occurences of the following sequence occur: inoperative 4 state 150, to car active state 126, to car stop state 136, to inoperative 4 state 150, then an abnormal elevator failure has occured in the which door open mechanism has failed with no one inside a car. This generates a message to the local of an abnormal elevator shutdown. A transition from the inoperative 4 state 150 to the occupied wait 1 state 162 occurs upon the detection of the alarm bell variable going true for greater than one second as indicated by a transitional line 206. This transition represents a trapped passenger.

Upon entrance by the state machine into the unoccupied 4 state 198 an abnormal elevator shutdown message (INOP) is sent to local. The state machine will remain in the unoccupied 4 state 198 until the door open variable is detected as going true. This causes an immediate transition to the car door open state 144 as indicated by a transitional line 208. An condition corrected message (CLR) is generated upon the occurence of such a transition.

The occupied wait 1 (OCCW 1) state 162 represents the detection of the alarm bell variable going true for greater than one second from any of the inoperative states 110, 122, 130, 140, 150 or from the service (attendant) state 114. Upon entrance into the occupied wait state 162 by the state machine a timer begins accumulating up to three minutes. At the end of three minutes, if the state machine is still in the occupied wait 1 state 162 an immediate transition will be made to an occupied 1 (OCC 1) state 210 as indicated by a transitional line 212. It is possible to transition from the occupied wait 1 state 162 upon the detection of the door open variable going true as indicated by a transitional line 214 to the car door open state 144. This would represent the escape of a trapped passenger out of the elevator car and would therefore cancel any potential occupied alarm.

The occupied 1 state 210 is entered upon expiration of the three minute timer from the occupied wait state. It represents the detection of a trapped passenger. Upon entrance into the occupied 1 state 210 a message of an occupied abnormal elevator shutdown (OCC1) is immediately transmitted to the local. The onlv way to exit the occupied 1 state 210 is by the detection of the door open variable going true as indicated by a transitional line 216 to the car door open state 144. This represents the escape of a passenger from the trapped elevator and causes the generation of a message of alarm condition corrected (CLR) to the local.

The inoperative state 5 156 represents the failure of the hoistway door actuators to open. It is entered from the car door open state 144 if the hoistway doors do not open within twenty seconds after entering the car door open state 144. Upon entrance into the inoperative 5 state 156 the state machine begins a timer which measures how long the state machine remains in the inoperative 5 state 156. If after twenty minutes the hoistway car doors have not opened, a transistion is made into an unoccupied 5 (UNNOC 5) state 218 as indicated by a transitional line 220. It is possible to transition from the inoperative 5 state 156 to the car idle state 102 before twenty minutes elapses if the door switch variable goes false as indicated by a transitional line 222. It is also possible to transition from the inoperative 5 state 156 if the alarm bell variable is detected true for a period of greater than one second as indicated by a transitional line 224 to an occupied wait 3 (OCCW 3) state 226.

The unoccupied 5 state 218 is entered upon the state machine remaining in the inoperative 5 state 156 for greater than twenty minutes. Upon entering the unoccupied 5 state 218 an immediate message of an abnormal elevator shutdown (INOP) is transmitted to the local. The state machine will remain in the unoccupied 5 state 218 until the detection of the door switch variable going false which produces an immediate transition to the car idle state 102 as indicated by a transitional line 228. This also results in the transmission of a message to the local of the alarm condition corrected (CLR).

The occupied wait 3 state 226 is entered from the inoperative 5 state 156 upon detection of the alarm bell variable going true for greater than one second. It represents the detection of a trapped passenger due to the hoistway door failure. A timer is enabled upon entering the occupied wait 3 state 226. If after three minutes, the hoistway doors have not been detected in the opened condition, i.e., the door switch variable remains true, an immediate transition is made to an occupied 3 (OCC 3) state 230 as indicated by a transitional line 232. Detection of the door switch variable going false (this would represent the opening of the hoistway doors and the escape of the trapped passenger) from the car produces an immediate transition to the car idle state 102 as indicated by a transitional line 234.

Upon entering the occupied 3 state 230 from the occupied wait 3 state 226 a message is transmitted to the local of an occupied abnormal elevator shutdown (OCC). The state machine remains in the occupied 3 state 230 until the detection of the hoistway door switch variable going false. This represents the escape of the trapped passenger via the hoistway doors and will generate a message to the local of alarm condition corrected (CLR). Upon detecting the hoistway door switch variable going false the state machine will sequence from the occupied 3 state 230 to the car idle state 102 as indicated by a transitional line 236. This also results in the transmission of a message to the local of the alarm condition corrected (CLR).

The emergency stopped state 172 functionally represents the pushing of the emergency stop button in the elevator car to prevent the car doors from closing in their normal sequence. A transition into the emergency stopped stop state 172 from the inopertive 2 state 122 prevents the sending of either an unoccupied or occupied alarm while the car is being held at the floor. The only exit from the emergency stopped state 172 is the release of the emergency stopped button. This generates an immediate transition back to the inoperative 2 state 122 as indicated by a transitional line 238.

The inoperative 6 state 140 functionally represents the stoppage of the elevator car by an opening of the safety chain. Upon entrance into the inoperative 6 state, a twenty minute timer begins to measure the time that the state machine occupies the inoperative 6 state 140. If after twenty minutes the safety chain variable does not go true, the state machine will transition to an unoccupied 6 (UNNOC 6) state 240 as indicated by a transitional line 242. Detection of the safety chain variable going true will abort the twenty minute timer and result in an immediate transitions to the car stopped state 136 as indicated by a transitional line 244. The normal variable is included in the expression adjacent to the transitional line 242 in FIG. 2 for the multi-car configuration as explained earlier in connection with transitional lines 176, 186, 200, 220. A transition from the inoperative 6 state 140 is the detection of the alarm bell variable going true for greater than one second as indicated by a transitional line 246 to the occupied wait 1 state 162. This would represent a trapped passenger.

Upon entrance into the unoccupied 6 state 240, an abnormal elevator shutdown message (INOP) is sent to local. The state machine will remain in the unoccupied 6 state 240 until the detection of the safety chain variable going true. This generates an immediate transition to the car idle state 102 as indicated by a transitional line 248. It also generates a message to the local of an alarm condition corrected message (CLR).

The car parked state 146 represents the car parking function associated with multiple hoistways and multi-car groups. The car parked state is entered from the car stopped state 136 if the car parked recognition variable goes false. A transition from the car parked state 146 to the car idle state 102 occurs when the button variable is detected with a true value. This would represent a generated go signal from a controller to dispatch a car to a designated hall call. It is represented by a transitional line 250. An abnormal transition from the car parked state 146 occurs if the alarm bell variable goes true for a period of greater one second as indicated by an transitional line 252 to an occupied wait 2 (OCCW 2) state 254. This would represent the occurrence of a trapped passenger due to the car parked recognition relay. A second abnormal transition can occur if the door open variable goes true as indicated by a transitional line 256 to the car door open state 144. This represents the escaping of a trapped passenger from the elevator car.

The occupied wait 2 state 254 represents the detection of a trapped passenger due to the car parked recognition relay failure. Upon entrance into the occupied wait 2 state 254 a timer is enabled. If this timer accumulates three minutes of time then an immediate transition is made to an occupied 2 (OCC 2) state as represented by a transitional line 260. If the door open actuator input variable goes true before three minutes elapses the timer is disabled and a transition is made to the car door open state as indicated by a transitional line 262. This represents the escaping of a trapped passenger from the elevator car.

The occupied 2 state 258 represents the detection of a trapped passenger. Entrance into the occupied 2 state 258 results in a message of occupied abnormal elevator shutdown (OCC) to the local. The state machine remains in the occupied 2 state until the door open variable is detected true which results in a transition from the occupied 2 state 258 to the car door open state 144 as indicated by an transitional line 264. This transition generates the transmittal of a message to the local of alarm condition corrected (CLR).

The state machine described herein performs the functions of monitoring normal elevator performance. Contained within the state diagram of FIG. 2 are numbered hexagons. These hexagons represent the enabling and disabling of timers and counters for the accumulation of performance data. Entrance into abnormal elevator conditions as designated by inoperative conditions or the occurrence of entrance into occupied wait conditions will, in general, disable the accumulation of performance data associated with the state of the car. This is to prevent excessive counting of elevator demand time, run time, etc., as a result of an abnormal elevator shutdown. The functions of the various timers and counters as represented by the numbered hexagons of FIG. 2 are described more fully in Table IV which is self-explanatory when viewed in connection with FIG. 2 and the description below.

TABLE IV

1. Start Demand Timing
2. Stop Demand Timing
3. Start Machine Run Timing
4. Stop Machine Run Timing, Increment Machine Run Counter, Determine OFR Status
5. Increment Door Operation Counter
6. Start Door Close Timer On DO(T) To DO(F) Transition
7. Stop Door Close Timer
8. Increment Slow Brake Lift Counter. Set Flag and Count Successive Occurences. If 5 Send Unoccupied Alarm. Clear Flag On Any Brakelift.
9. Set Flag and Count Successive Occurences. If 5 Send Unnoccupied Alarm. Clear Flag On DO(T)
10. Increment Car Part Counter
11. Check Levelling And Note Exceedance
12. Increment Counter
13. Increment Counter
14. Increment Counter Upon a transition from the car idle state 102 to the car call state 106 a demand timer (not shown) begins accumulating time in seconds. This is indicated by hexagon 1 in FIG. 2. This timer will be disabled upon the transition from the car active to the car stop state as indicated by hexagon 2. The total accumulated demand time associated with a car is accumulated over the twenty-four hour period of performance monitoring (the normal period for performance monitoring).

Upon transition from the car ready state 118 to the car active state 126 due to a brakelift, a machine run timer (not shown) begins the accumulation of time in seconds. The initiation of the machine run timer is indicated by hexagon 3. This timer is disabled upon the detection of a brakedrop as indicated by hexagon 4 as a result of a transition from the car active state 126 to the car stop state 136. The total machine run time for the elevator car is accumulated over the performance period of twenty four hours. The number of runs for the elevator is accumulated by counting the transitions from car ready state 118 to the car active state 126.

Upon a transition from the car door open state 144 to the car idle state 102 as a result of detecting a hoistway door opening, a door operations counter (not shown) is incremented as indicated by hexagon 5. The total accumulation of door open operations is maintained over the performance period of twenty-four hours.

When the elevator doors close, a transition of the door open variable from a true to false value occurs. A door closed timer (not shown) begins incrementing time in seconds upon the occurrence of this transition as indicated by hexagon 6. Upon the transition from the car call state 106 to the car ready state 118 due to the detection of the hoistway door closing, this timer shall be inhibited as indicated by hexagon 7. The amount of accumulated time is then compared to the door close limit value for the elevator. In the event that this time is greater than the door closed limit time, a door closed exceedence is detected. This is added to an accumulated value for door closed exceedences over the twenty-four performance monitoring period.

Any transition from the car ready state 118 to the inoperative 3 state 130 results in the incrementing of a slow brake counter (not shown) as indicated by hexagon 8. In this way, all occurences of brakelifts of greater than fifteen seconds are counted over the performance period. The monitoring of this performance value will give an indication to the local office of an impending failure.

Any transition from the car stop state 136 to the inoperative 4 state 150 due to the failure of the door open actuator to open within five seconds results in the incrementing of a door open actuator failure counter (not shown) as indicated by hexagon 9. The total number of counts over the performance period shall in this way be monitored. This number gives an indication of an impending door open actuator failure.

Every transition from the car stopped state 136 to the car parked state 146 results in the incrementing of a car parked recognition counter (not shown) as indicated by hexagon 10. In this way excessive car parking for an elevator can be detected over the performance period measured.

Every transition from the car call state 106 to the inopertive 2 state 122 results in the incrementing of a hoistway door closure failure counter, (not shown) as indicated by hexagon 13. In this way, pending failure of a hoistway door closure shall be detected over the performance period.

Every transition from the car door open state 144 to the inoperative 5 state 156 due to the failure of the hoistway doors to open within twenty seconds results in the incrementing of the hoistway open door failure counter (not shown) as indicated by hexagon 14. In this way an impending failure of hoistway doors to open can be monitored over the performance period.

For all of the inoperative states, a value limit can be associated therewith. The exceedence of this limit by a counter may be setup to generate an alarm to the local office indicating the exceedence of the limit value specified. The purpose of this alarm is to alert the local office of a performance malfunction within an elevator prior to an actual elevator shutdown.

Upon entering the car door open state 144, the state machine checks for a true master floor condition in order to perform a levelling check. In other words, one of the floors is selected as the master floor and a levelling check is performed each time the car stops at that floor. If levelling has occurred within established acceptability limits a levelling variable is set to a true value which indicates that the car has stopped within a fixed level distance to the floor landing. A failure to level at the master floor results in the incrementing of a levelling failure counter (not shown) as indicated by hexagon 11. In this way, levelling failures can be monitored over the performance period. On some elevator configurations it is desirable to measure levelling at all floor landings.

The number of one-floor runs for the elevator are accumulated on the transition into the car active state 126. The detection of a one-floor run is accumulated over the performance period. This is indicated by hexagon 4.

The transition into the car idle state 102 as a result of the hoistway door lock opening, increments the door operation counter. This results in the accumulation of door operations over the performance period as indicated by hexagon 5.

It should be understood that although the present invention has been described in detail in connection with the remote elevator monitoring system of FIGS. 1 and 2 and in connection with the hardware implementation of the Whynacht disclosure expressly incorporated by reference hereinbefore, the invention is not necessarily restricted thereto. For instance, the state machine described in FIG. 2 for use in the master 18 of FIG. 1 in a remote building 12 could easily be adapted to another type of operating system which operates in a manner which may be modeled in a state machine description similar to FIG. 2.

Thus, although the invention has been shown and described with respect to a preferred embodiment thereof, it should be understood by those skilled in the art that the foregoing and various other changes, omissions, and additions may be made therein without departing from the spirit and scope of the invention.

We claim:

1. Apparatus for evaluating the performance of at least one operating system which normally operates sequentially from state-to-state in a closed loop sequential chain of linked normal operating states, said apparatus minitoring the states of a plurality of two-state parameter signals provided by each monitored system, each parameter signal representative of a different one of a like plurality of operating system parameters, said apparatus providing periodic performance message signals indicative of the various possible operating conditions of each monitored system including inoperative conditions indicative of system degradation, said apparatus also providing immediate alarm message signals indicative of system failures requiring immediate corrective action, comprising:

signal processor means, responsive to said two-state parameter signals from each monitored system, and having means for storing signals including said two-state parameter signals, and having means for comparing the states of parameter signals selected according to the present operating condition of each monitored system with stored signals indicative of transitions from said present operating condition to a subsequent operating condition, said comparing means detecting transitions from said present operating condition to an inoperative condition, to an operative condition and to an alarm condition, and for providing transition signals indicative thereof, said signal processor having means for counting transition signals indicative of transitions between particular normal operating conditions of each monitored system, for counting transition signals indicative of transitions between particular normal operating conditions and particular inoperative conditions, said signal processor having means for periodically providing performance message signals indicative of the count of detected transitions for each monitored system, said signal processor also having means for providing immediate alarm message signals for each monitored system indicative of detected transitions from inoperative conditions to alarm conditions; and display means, responsive to said alarm message signals for displaying alarm messages corresponding to each alarm condition detected in each monitored system, and responsive to said performance message signals for displaying performance messages corresponding to the count of said detected transitions in each monitored system.

2. Apparatus according to claim 1, further comprising:

remote communication element means, one for each operating system, responsive to its system's alarm and performance message signals for transmission thereof;

at least one local service office communication element means, responsive to said alarm and performance message signals transmitted from at least one associated remote communication element means for providing each associated operating system's alarm and performance message signals; and at least one local service office display means responsive to said alarm and performance signals from an associated local communication element means, for displaying alarm and performance messages corresponding to each alarm and selected system condition detected in said associated operating system.

3. Apparatus according to claim 2, wherein said local service office communication element means retransmits said alarm and performance message signals, said apparatus further comprising:

central communication element means, responsive to said retransmitted alarm and performance message signals from each of said local communication element means, for providing each operating system's alarm and performance message signals; and central display means, responsive to each operating system's alarm and performance message signals, for displaying alarm and performance messages corresponding to each alarm and selected system condition detected in each operating system.

4. A signal processing method for monitoring the condition of a system which normally operates sequentially from state-to-state in a closed loop sequential chain of linked normal operating states, comprising the steps of:

monitoring a plurality of parameter signals indiciative of a corresponding plurality of sensed parameters in the monitored system for determining if any of a plurality of criteria defining operating state transitions are satisfied;

determining the identity of the present operating state of the monitored system, at the time a transition is made thereto, by detecting the satisfaction of a transition criterion defining a transition from an immediately preceding operating state by detecting the parameter state or states, alone or in combination, of one or more sensed parameter signals defining the satisfied transition criterion;

after detecting that the system has entered the presently identified operating state, repeatedly checking for the presence of a transition from the present operating state via one of a plurality of defined possible transitions to a corresponding one of a plurality of immediately succeeding operating states by testing for the satisfaction of one of a corresponding plurality of criteria each defined by one of more parameter signals, alone or in combination, each criteria corresponding to one of the defined possible transitions, each criteria indicating a particular transition within one of the following two categories of system transitions:

(a) a system transition from its present operating state to a particular one of the normal operating states in the closed loop sequential chain of linked normal operating states;

(b) a system transition from its present operating state to a particular one of a plurality of abnormal operating states; and providing a selected message signal in the presence of a determination that a transition to or from a particular abnormal operating state has occured.

5. The method of claim 4, further comprising the step of providing a verbal message in response to the message signal.

6. The method of claim 4, further comprising the step of transmitting the message signal to a distant office.

7. The method of claim 6, further comprising the step of providing a verbal message in response to the transmitted message signal.

8. The method of claim 6, further comprising the step of receiving the transmitted message signal at a local service office and retransmitting the message signal to a central office.

9. The method of claim 8, further comprising the step of providing a verbal message in response to the retransmitted message signal.

10. The method of claim 4, wherein the message signal increments a count or starts a timer and merely indicates a transition to an inoperative state indicative of system performance degradation.

11. The method of claim 10, wherein the message signal indicates a transition from an inoperative state to an alarm state indicative of a need for immediate corrective action.

12. The method of claim 11, wherein the message signal indicates a transition from an alarm state to a normal operating state.

13. Apparatus for monitoring the condition of a system which normally operates sequentially from state-to-state in a closed loop sequential chain of linked normal operating states, comprising:

signal processor means, for monitoring a plurality of parameter signals indicative of a corresponding plurality of sensed parameters in the monitored system for determining if any of a plurality of criteria defining operating state transitions are satisfied by firstly, determining the identity of the present operating state of the monitored system, at the time a transition is made thereto, by detecting the satisfaction of a transition criterion defining a transition from an immediately preceding operating state by detecting the parameter state or states, alone or in combination, of one or more sensed parameter signals defining the satisfied transition criterion, and secondly, after detecting that the system has entered the presently identified operating state, repeatedly checking for the presence of a transition from the present operating state via one of a plurality of defined possible transitions to a corresponding one of a plurality of immediately succeeding operating states by testing for the satisfaction of one of a corresponding plurality of criteria each defined by one or more parameter signals, alone or in combination, each criteria corresponding to one of the defined possible transitions, each criteria indicating a particular transition within one of the following two categories of system transitions:

(a) a system: transition from its present operating state to a particular one of the normal operating states in the closed loop sequential chain of linked normal operating states;

(b) a system transition from its present operating state to a particular one of a plurality of abnormal operating states, said signal processor providing a selected message signal in the presence of a dtermination that a transition to or from a particular abnormal operating state has occurred; and communication element means, responsive to message signals for transmission thereof.

14. The apparatus of claim 13, further comprising:

local service office communication element means, responsive to said message signals transmitted from said communication element means for providing message signals at a local service office; and local service office display means, responsive to said message signals from the local service office communication element means, for displaying a verbal message corresponding to each message signal.

15. The apparatus according to claim 14, wherein said local service office communication element means retransmits said message signals, said apparatus further comprising:

central communication element means, resonsive to said retransmitted message signals for providing said message signals; and central display means, responsive to each message signal for displaying a verbal message corresponding to each message signal.

* * * * *